US009427744B1

(12) United States Patent
Stunkard

(10) Patent No.: US 9,427,744 B1
(45) Date of Patent: Aug. 30, 2016

(54) METHODS FOR PROCESSING CARBONACEOUS MATERIALS

(71) Applicant: CALGON CARBON CORPORATION, Moon Township, PA (US)

(72) Inventor: Charles B. Stunkard, New Brighton, PA (US)

( * ) Notice: Subject to any disclaimer, the term of this patent is extended or adjusted under 35 U.S.C. 154(b) by 167 days.

(21) Appl. No.: 14/158,222

(22) Filed: Jan. 17, 2014

Related U.S. Application Data

(60) Provisional application No. 61/753,707, filed on Jan. 17, 2013.

(51) Int. Cl.
*B02C 23/00* (2006.01)

(52) U.S. Cl.
CPC ..... *B02C 23/00* (2013.01)

(58) Field of Classification Search
CPC ..... B02C 23/00; B02C 25/00; B02C 23/10; B02C 23/14; B02C 23/16; C22B 1/24
USPC ..... 241/3, 101.4
See application file for complete search history.

(56) References Cited

U.S. PATENT DOCUMENTS 1,481,427 A * 1/1924 McIntire ..... C10L 5/02 241/47
1,746,767 A * 2/1930 Debauche ..... C10L 5/02 241/24.31
2,556,154 A * 6/1951 Kern ..... C10B 53/08 201/20
3,852,216 A 12/1974 Ninomiya et al.
5,254,521 A 10/1993 Knudson
6,079,644 A * 6/2000 Linde ..... C09D 17/005 241/22
6,241,167 B1 * 6/2001 Linde ..... C09D 17/005 241/22
7,913,939 B2 * 3/2011 French ..... B03B 9/005 241/101.4
2006/0204429 A1 9/2006 Bool, III et al.
2006/0204430 A1 9/2006 Bool, III et al.
2007/0254807 A1 11/2007 Bisque et al.
2011/0167715 A1 * 7/2011 French ..... B03B 9/005 44/591
2013/0146686 A1 * 6/2013 Schlegel ..... B02C 23/08 241/17
2013/0216831 A1 8/2013 Kirschbaum et al.
2013/0241094 A1 9/2013 Yu et al.
2013/0326938 A1 12/2013 French et al.

FOREIGN PATENT DOCUMENTS

WO WO 2006/099290 9/2006

* cited by examiner

*Primary Examiner* — Faye Francis
(74) *Attorney, Agent, or Firm* — Pepper Hamilton LLP

(57) ABSTRACT

Methods for processing carbonaceous materials to produce on-sized granulated materials. Such methods provide improved starting materials for production of, for example, activated carbon.

6 Claims, 2 Drawing Sheets

PRIOR ART

METHODS FOR PROCESSING CARBONACEOUS MATERIALS

CROSS-REFERENCE TO RELATED APPLICATIONS

This application claims priority to U.S. Provisional Application No. 61/753,707, entitled, "Methods For Processing Carbonaceous Materials," filed Jan. 17, 2013, which is incorporated herein by reference in its entirety.

GOVERNMENT INTERESTS

Not Applicable

PARTIES TO A JOINT RESEARCH AGREEMENT

Not Applicable

INCORPORATION BY REFERENCE OF MATERIAL SUBMITTED ON A COMPACT DISC

Not Applicable

BACKGROUND

Not Applicable

SUMMARY

Description of Drawings

For a fuller understanding of the nature and advantages of the present invention, reference should be made to the following detailed description taken in connection with the accompanying drawings, in which.

DETAILED DESCRIPTION

Before the present compositions and methods are described, it is to be understood that they are not limited to the particular compositions, methodologies or protocols described, as these may vary. It is also to be understood that the terminology used in the description is for the purpose of describing the particular versions or embodiments only, and is not intended to limit their scope which will be limited only by the appended claims.

It must also be noted that as used herein and in the appended claims, the singular forms "a," "an," and "the" include plural reference unless the context clearly dictates otherwise. Unless defined otherwise, all technical and scientific terms used herein have the same meanings as commonly understood by one of ordinary skill in the art. Although any methods and materials similar or equivalent to those described herein can be used in the practice or testing of embodiments disclosed, the preferred methods, devices, and materials are now described.

"Optional" or "optionally" means that the subsequently described event or circumstance may or may not occur, and that the description includes instances where the event occurs and instances where it does not.

"Substantially no" means that the subsequently described event may occur at most about less than 10% of the time or the subsequently described component may be at most about less than 10% of the total composition, in some embodiments, and in others, at most about less than 5%, and in still others at most about less than 1%.

Various embodiments are directed to methods for processing carbonaceous materials such as, for example, coal. Such methods generally include the steps of pulverizing the carbonaceous material, sizing the pulverized carbonaceous material, briquetting the ground material, crushing the briquetted material, and sizing the crushed briquetted material. The materials may be screened between one or more of these steps to ensure that the material being used in the proceeding steps are appropriately sized, and in some embodiments, materials that are not appropriately sized may be recycled and reintroduced into the process at a preceding step of the process. Additional embodiments are directed to improvements of various steps in such methods that improve the quality of the processed material and the final product. The various steps of the methods described herein can be used in the production of any material that includes a carbonaceous precursor, and in certain embodiments, the carbonaceous material may be used in the production of activated carbon. In other embodiments, carbonaceous materials can be used for, for example, heat production, electricity production, conversion to fuel, cement manufacturing, water purification, and the like.

Figure 1:
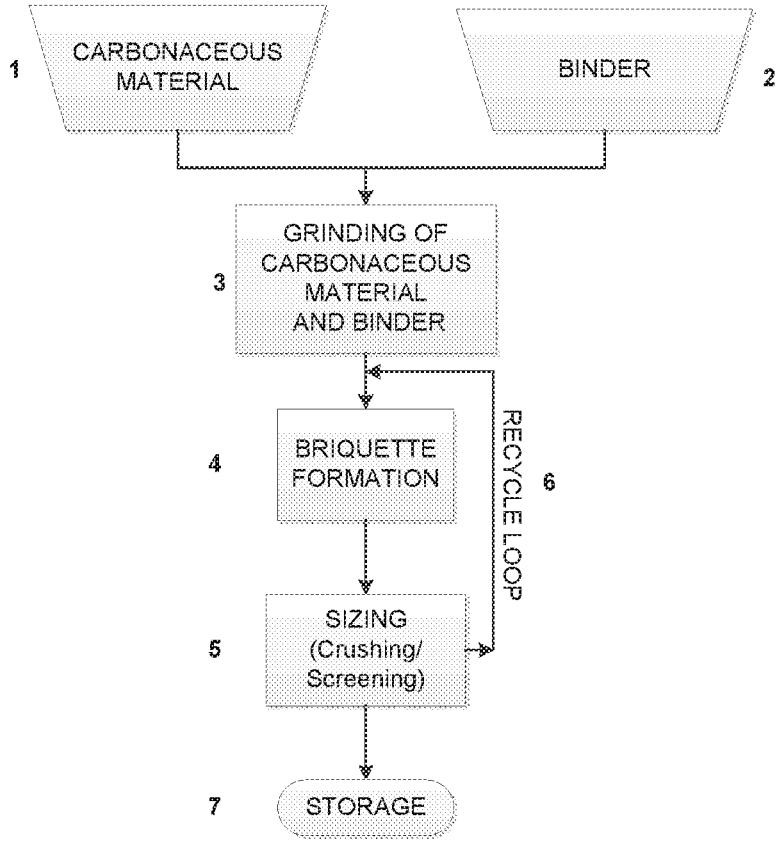
FIG. 1 is a process flow chart summarizing the production of activated carbon from coal.

FIG. 1 shows a flow diagram illustrating a summary of a typical method for processing carbonaceous materials. In a first step, a carbonaceous material 1 is mixed with one or more binders, additives, or combinations thereof 2. This mixture is then pulverized and dried 3. The mixing, pulverizing, and drying steps can be carried out as consecutive steps in different portions of the apparatus, and these steps may be carried out in any order. For example, in some embodiments, these steps may be carried out in the order: mixing, pulverizing, drying, and in other embodiments, the steps may be carried out in the order: mixing, drying, pulverizing. In certain embodiments, combinations of these steps can be carried out simultaneously. For example, the mixing can be carried out independently and pulverizing and drying can be carried out simultaneously in the same apparatus. In other embodiments, mixing and drying can be carried out simultaneously and pulverizing can be carried out independently.

After the carbonaceous material binder mixture has been pulverized and dried, the carbonaceous material can be briquetted 4. Briquetting, as used herein, refers to any process in which individual particles of pulverized carbonaceous material are agglomerated, and briquetting can be carried out by any means known in the art. In a typical briquetting process, agglomerated carbonaceous material are formed into units having a particular size and shape, i.e., briquettes. To ensure that the briquettes are properly sized, in some embodiments, briquettes emerging from the briquetting apparatus may undergo a screening process 5. In some embodiments, the briquettes may be crushed following briquetting to produce smaller particles of agglomerated material that can undergo further processing, and in certain embodiments, activation. In some embodiments, the crushed agglomerated material can be sized to provide agglomerated particles within a particular size range. Particles that meet the standard size range can immediately undergo further processing, or in some embodiments, particles that meet standard size ranges can be packaged or storage or processing at a different 7. Particles that do not meet sizing standards that are two large may be recycled and crushed by a separate apparatus or fed into the briquette crushing apparatus. Particles that are smaller than standard size (i.e., fines) can be recycled through a recycle loop 6 that combines these fines with pulverized carbonaceous materials for briquetting. The fines recycling loop can introduce the fines into the pulverizing apparatus where the fines are combined with the pulverized materials, or the fines can be introduced directly into the briquetting apparatus where mixing with the dried pulverized material can be carried out.

Embodiments are not limited by the type of carbonaceous material that can be processed using the methods exemplified above. For example, in various embodiments, the carbonaceous materials can be coal, lignite, cement, oil shale, and combinations thereof. Similarly, embodiments are not limited by the binders and/or additives combined with the carbonaceous materials, and in some embodiments, no binders or additives are combined with the carbonaceous material before pulverizing and drying. In such embodiments, the mixing step described above can be omitted. In embodiments in which a binder is added, the binder may be any material that can enhance the briquetting process or produce briquettes of desired quality. For example, suitable binders include, but are not limited to, magnesia, pitch, sulphite-liquor residues, starch, and combinations thereof.

Figure 2:
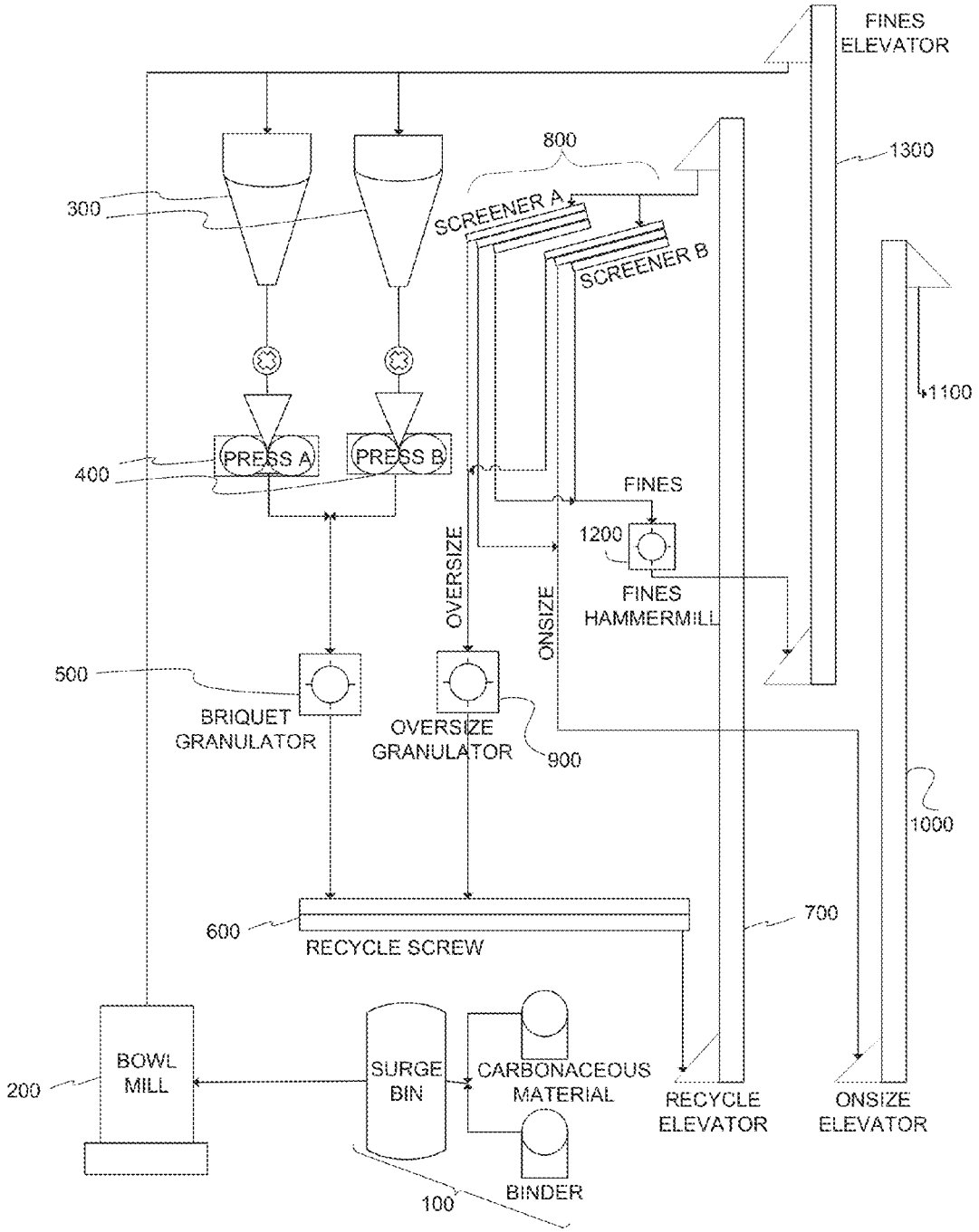
FIG. 2 is a process flow diagram detailing the production of activated carbon from coal including all equipment typically used in a press room.

FIG. 2 shows an illustrative example of processing mill (i.e., a system) used for the production of agglomerated carbonaceous materials using the methods described above. The various apparatuses and processing machinery used in FIG. 2 are for illustrative purposes only and other similar or equivalent devices and machinery can be used in other embodiments. As illustrated in FIG. 2, carbonaceous materials and binder materials can be fed into the system by introducing the raw materials into hoppers or other bins that allow a steady stream of material to be introduced onto a conveyor 100. In some embodiments, separate conveyors may carry the carbonaceous material and binder materials to a pulverizing mill, and in other embodiments, a single conveyor may receive material from a carbonaceous material hopper and a binder hopper. In further embodiments, the carbonaceous material/binder mixture is fed by way of a single screw to the center of the bowl.

The carbonaceous material/binder mixture using any device for pulverizing known to exist in the art, and pulverizing equipment can be chosen based on the requirements necessary for pulverized materials having particular properties such as particle size. In FIG. 2, a bowl mill 200 is illustrated, and in other embodiments, the pulverizer may be a ball mill, tube mill, attrition mill, vertical roller mill, a hammer mill, jet mill, or the like. In embodiments, in which a bowl mill is used, the carbonaceous material and binder may be fed into the center of the bowl by a feed screw that can have a range of from about 0 to about 40%, about 0 to about 50%, or about 0 to about 60%. In certain embodiments, the bowl mill can include a rotating bowl an spring-balanced journals and grinding rings. The journals are free to turn on their axis, being driven by their contact with the carbonaceous material/binder layer deposited in the bowl. In use, the rotation of the bowl forces a carbonaceous material/binder mixture towards the periphery where it is pulverized by successive passes between the journals and a grinding ring.

In some embodiments, embodiments drying may be carried out during pulverizing by, for example, providing air flow into the pulverizing apparatus during pulverizing. For example, in certain embodiments, a double inverted-cone separator can be mounted on the body of the pulverizing device, and an annular flow of hot air may be introduced into the pulverizing device through the separator. The air flow may dry the carbonaceous material binder mixture during pulverization and may additionally carry the pulverized product toward the separator where particles meeting certain size requirements are removed from the pulverizer. The fineness of the pulverized particles may vary among embodiments and can be for example, about 50%, about 60%, about 70%, about 80%, about 90% below −325 mesh or any range encompassed by these values. Such particles can have an average particle diameter of about 50 μm to about 100 μm, about 60 μm to about 90 μm, or in particular embodiments, about 80 μm.

In some embodiments the relationship of flow rate of the air introduced into the pulverizing apparatus to the particle size distribution can be used to provide particles having a particular size distribution. In particular, the particle size distribution will shift towards smaller particles as the flow rate of air introduced into the pulverizing apparatus increases. In slower moving air, particles that are too heavy or large to be carried by the air stream fall back from the interior cone into the center of the bowl mill table. The particles will be ground again until they have reaches a small enough size to allow them to be carried out of the pulverizer by the air stream.

The flow rate of the air introduced into the pulverizer can be regulated bases on the amperage at which the blower motor runs. At higher amperage, the blower runs faster pushing more air into the pulverizer, and at lower amperage the blower runs more slowly pushing less air into the pulverizer. To achieve particles having the size distribution provided above, about 50% to about 90% below −325 mesh, air may be introduced into the pulverizer at about 125 amps to about 220 amps, about 135 amps to about 210 amps, or about 100 amps to about 200 amps, or any range encompassed by these values.

The temperature at which pulverizing is carried out can have a significant effect on the product. For example, if the temperature during grinding is too high, the carbonaceous material can catch fire, and if the carbonaceous material is too low, the pulverized material may be too wet, which can hinder the briquetting process and produce agglomerated particles that are not suitable for further processing. While embodiments are not limited to particular temperatures, and the temperature can vary depending on, for example, ambient temperatures or other external weather conditions, in some embodiments, pulverizing can be carried out at a temperature of from about 95° F. to about 115° F. (about 35° C. to about 46.1° C.), about 90° F. to about 120° F. (about 32.2° C. to about 48.9° C.), or about 100° F. to about 160° F. (about 37.8° C. to about 71.1° C.). Heat may be applied to the pulverizer by any means. For example, in some embodiments, the air introduced into the pulverizer may be heated before entering the pulverizer. In other embodiments, a heating coil may be provided around the pulverizer to heat the apparatus itself during pulverizing. The heating coil may be heated in any way including, for example, electric heating, forced air heating, gas or in particular embodiments, steam or another gas may be used to heat the loop. In certain embodiments, heat may be applied to the pulverizer using a blower with a damper that forces air over steam fed preheating coils.

In some embodiments, the heating temperature may regulates the residual moisture in the pulverized carbonaceous material. The heating the carbonaceous material drives moisture from the carbonaceous material during pulverizing producing a product having less moisture than the material introduced into the pulverizer. However, over drying can inhibit briquette formation, and under drying can result in particle degradation during the high temperature baking processes. Therefore, the temperature must be selected that eliminates sufficient moisture from the carbonaceous material without over or under drying while ensuring that the temperature is not sufficiently high to create a fire hazard. Applicant has found that heating to within the ranges recited above, i.e., from about 95° F. to about 115° F. (about 35° C. to about 46.1° C.), about 90° F. to about 120° F. (about 32.2° C. to about 48.9° C.), or about 100° F. to about 160° F. (about 37.8° C. to about 71.1° C.), achieves a residual moisture content for most carbonaceous materials, and in particular, coal of from about 1% to about 2% by weight, about 0.9% to about 1.5% by weight or about 0.5% to about 1.25% by weight.

Following pulverizing the pulverized material can be collected and moved to the briquetting apparatus. In some embodiments, a cyclone can be used to separate the pulverized material from the air flow in the pulverizer. In such embodiments, the air stream containing the pulverized product flows into a cyclone where the rotating flow of air causes the pulverized particles to contact the walls of the cyclone and gravity causes the particles to fall along the inner wall to the bottom of the cyclone where it exits the cyclone and leaves the cyclone. The pressure drop range measures reduction in pressure as the air travels up the cyclone, and the pressure drop can affect the size of the particles that are removed by the cyclone while eliminating very fine particles and dust. In some embodiments, the cyclone may have a pressure drop of from about 4.5 inches to about 9.5 inches or about 5.5 inches to about 7.5 inches in a water column. In some embodiments, the pulverized product may exit the cyclone through a rotary air lock and travel along a mixing screw conveyor into a press feed bin 300 where the pulverized particles are collected.

After collecting in feed bin, an amount of pulverized particles is introduced into briquetting presses 400. In certain embodiments, a roll briquetting machine may be used to create the briquettes. Using such roll briquetting machines, the pulverized material is fed through outlet into forming cavities in opposing rolls. The rolls come together pressing the filling forming cavities together, forcing out air, and forming the briquette. Formed briquettes drop through outlet onto a conveyor.

The roll press are, generally, controlled through four main inputs: roll speed, hydraulic ram pressure, feeder amps, and roll amps. Hydraulic ram pressure determines the pressure used to compress the cavities on the opposing rolls during briquette formation. Typical target hydraulic pressures can be from about 1800 pounds per square inch (psi) to about 3000 psi, and in in some embodiments, the hydraulic pressure can be from about 2200 psi to about 2800 psi, about 2100 psi to about 2400 psi, or any range between the values.

The roll speed can vary among embodiments and can be depended on the feeder rate. Like the blower, feeder rate and roll rate can be measured based on the amperage applied to the respective motors. For example, the feeder may run at an output range of from about 10 amps to about 50 amps, about 20 amps to about 45 amps, about 28 amps to 40 amps, or any range or value within these ranges. The feeder screw speed can vary depending on the feeder rate as indicated by the amperage applied to the motor.

The roller motor may have an output range of about 140 to about 200 amps, about 150 amps to about 190 amps, about 160 amps to about 180 amps or any range or value there between to produce a roller speed of about 5 RPM to about 100 RPM, about 10 RPM to about 75 RPM, about 20 RPM to about 50 RPM or any range or value there between.

Embodiments of the invention include any combination of feeder rates, roller speeds or rates, and hydraulic pressures selected from the ranges set-forth above, and variation in these combinations of values can occur during operation or among different operations. Some embodiments include a feedback loop that can change one or more of the feeder rate, roller speed, and hydraulic pressure during operation of the briquetting apparatus. For example, a reduction in measured pressure during the briquetting process can cause an increase in feeder rate and/or a reduction in roller speed. Such changes can be carried out manually, or automatic feedback loops. Automatic feedback loops can include one or more sensors associated with the feeders, rollers, presses, and other components of the briquetting device and a control unit electronically connected to the these sensors that can monitor the sensors and alter feed rates, roller speeds, and hydraulic pressures during briquetting to maintain pre-identified thresholds. In such embodiments, users can interrupt or change such thresholds either during operation or between operations, and in certain embodiments, the feedback loop may include an alarm to notify the user that the pre-identified thresholds have been breached. In some embodiments the briquetting is carried out in an inert environment.

In some embodiments a vacuum or other means for de-aeration can be applied on the press feeders to increase the density of the pulverized mixture. In some embodiments, the briquetting process can be carried out under vacuum at reduced pressure. For example, briquetting can be carried out at from about $10^{-2}$ torr to about $10^{-7}$ torr or any range or value there between. In certain embodiments, de-aeration may include introducing an inert gas into the briquetting apparatus to remove air during the briquetting processes. Inert gases are known in the art, and any inert gas can be used in embodiments of the invention.

Some embodiments can also have output controls that include a feeder screw speed and a vacuum valve to control release of the briquettes from the briquetting apparatus. In some embodiments, the feeder screw speed may be related to the amperage of the screw motor and can be from about 100 amps to about 180 amps, about 110 amps to about 150 amps, about 100 amps to about 140 amps or any range or value there between, and the vacuum valve output range may be from about 5 psi to about 25 psi, about 7 psi to about 15 psi, or any range there between.

In some embodiments, briquetting may be carried out using only pulverized material. In other embodiments, briquetting can be carried out with a mixture of pulverized material and pre-briquetted material. For example, in certain embodiments, the pulverized material may be mixed with granulated briquetted material. The granulated briquetted material may typically have a small particle size similar to that of the pulverized material, for example, about 50% to about 90% below −325 mesh or any value or range there between, and mixing can occur in the feed bins associated with the briquetting apparatus or in a separate device that mixes the pulverized material and granulated briquetted material. The amount of granulated briquetted material in the mixed material may vary among embodiments and can be from about 2% to about 20%, about 5% to about 15%, or about 7% to about 10% of the total mixture. This mixed material may then be fed into the briquetting machine to form briquettes. Without wishing to be bound by theory, the addition of granulated briquetted material may increase the packing density of briquettes made from these mixed material, which can improve the density of the activated carbon produced from the mixed material.

After the briquettes have been formed, they may be deposited on a conveyor and carried to a briquette granulator 500 for resizing. In the granulator, the briquettes are crushed to from granulated briquetted material or "agglomerated material." This crushed material can be deposited onto a screw conveyor 600 to a sizing screens where the crushed material is separated by size. In some embodiments, the product may be transferred to an elevator 700 where horizontal screeners 800 are used to separate particles of crushed material into on-size, oversized, and undersized particles Oversize particles may have a mean particle diameter of greater than about 60 μm or 70 μm, and can be reintroduced into the or introduced into a second granulator 900 before being re-sized using the screeners. Undersized particles or "fines" are separated can be discarded or reintroduced into the feed bins associated with the briquetting apparatus. In some embodiments, undersized particles that are introduced into the feed bins can be further pulverized to reduce the average particle diameter of the fines before being sent back to a press feed bin using a fines elevator 1300. Pulverizing can be carried out using any pulverizing apparatus known in the art such as, for example, a hammermill.

In some embodiments, the on-size particles may have a mean particle diameter of about 30 μm to about 70 μm, about 40 μm to about 60 μm or any volume between these ranges, and in certain embodiments, less than or equal to about 44 μm. On size particles can be conveyed to bins for storage or further processing. In some embodiments, the on-size product may be transferred from the screeners to an on-size product elevator 1000 and sent to storage in a feed bin 1100, and in certain embodiments, the product may be screened by a finish screener before being sent to storage.

The granulated on-size material can be used for any purpose. In certain embodiments, the on-size product may be used for the production of activated carbon.

What is claimed is:

1. A process for preparing granulated particles of a carbonaceous material comprising;

pulverizing carbonaceous material at a temperature of 100° F. to 160° F. (37.8° C. to 71.1° C.) to produce pulverized carbonaceous material;

sizing the pulverized carbonaceous material to produce sized, pulverized carbonaceous material;

briquetting the sized, pulverized carbonaceous material to produce briquetted carbonaceous material;

crushing the briquetted carbonaceous material to produce crushed, briquetted carbonaceous material and granulated briquetted material; and sizing the crushed briquetted carbonaceous material.

2. The method of claim 1, wherein briquetting is carried out in an inert environment.

3. The method of claim 1, wherein briquetting is carried out under vacuum.

4. The method of claim 1, wherein pulverizing results in pulverized carbonaceous material having a residual moisture level of 1% to 2% by weight.

5. The method of claim 1, further comprising mixing the pulverized carbonaceous material and granulated briquetted material before briquetting.

6. The method of claim 1, further comprising controlling feed rates, roller speeds, and hydraulic pressures during briquetting.

* * * * *